US010723143B2

(12) United States Patent
Andrea Tallada et al.

(10) Patent No.: US 10,723,143 B2
(45) Date of Patent: Jul. 28, 2020

(54) FORMATION OF GLOSS LEVEL AREAS HAVING A GLOSSY FINISH AND A MATTE FINISH IN AN IMAGE

(71) Applicant: Hewlett-Packard Development Company, L.P., Houston, TX (US)

(72) Inventors: Alex Andrea Tallada, Barcelona (ES); Carmen Blasco Cortes, Sant Cugat del Valles (ES); Xavier Quintero Ruiz, Sant Cugat del Valles (ES); David Ramirez Muela, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/298,076

(22) Filed: Oct. 19, 2016

(65) Prior Publication Data

US 2017/0036458 A1 Feb. 9, 2017

Related U.S. Application Data

(63) Continuation of application No. 14/767,093, filed as application No. PCT/US2013/026269 on Feb. 15, 2013, now Pat. No. 9,505,238.

(51) Int. Cl.
*B41J 11/02* (2006.01)
*B41J 11/00* (2006.01)

(52) U.S. Cl.
CPC ..... *B41J 11/002* (2013.01)

(58) Field of Classification Search
None
See application file for complete search history.

(56) References Cited

U.S. PATENT DOCUMENTS 7,433,627 B2 10/2008 German et al.
2006/0290760 A1* 12/2006 German ..... B41J 11/002 347/102
2008/0088689 A1 4/2008 Korem
2009/0225143 A1 9/2009 Fukui
2009/0262159 A1 10/2009 Lang
(Continued)

FOREIGN PATENT DOCUMENTS

EP 2111994 A2 10/2009

OTHER PUBLICATIONS

International Search Report and Written Opinion for PCT/US2013/026269 dated Feb. 15, 2013, 10 pp.

*Primary Examiner* — Erica S Lin
(74) *Attorney, Agent, or Firm* — HP Inc. Patent Department

(57) ABSTRACT

A method includes printing an image on substrate by a printhead using ultraviolet (UV) curable ink. The method includes selectively applying a first amount of UV radiation by a first region of a light source to a first area of the image after a first amount of time passes from printing the first area to form a first gloss level area having a glossy finish. The method also includes selectively applying a second amount of UV radiation by a second region of the light source to a second area of the image after a second amount of time passes from printing the second area to form a second gloss level area having a matte finish. At least one of the second amount of UV radiation is greater than the first amount of UV radiation and the first amount of time is greater than the second amount of time.

20 Claims, 6 Drawing Sheets

(56) References Cited

U.S. PATENT DOCUMENTS

| | | | | |
|---|---|---|---|---|
| 2010/0247795 | A1* | 9/2010 | Heath | C09D 11/101 427/511 |
| 2010/0304098 | A1 | 12/2010 | Ohno et al. | |
| 2011/0141184 | A1* | 6/2011 | Izuo | B41J 2/2142 347/19 |
| 2012/0062667 | A1 | 3/2012 | Roof et al. | |
| 2012/0223995 | A1 | 9/2012 | Kondo et al. | |

* cited by examiner

FORMATION OF GLOSS LEVEL AREAS HAVING A GLOSSY FINISH AND A MATTE FINISH IN AN IMAGE

BACKGROUND

Printing apparatuses include printheads to form images on substrate. A printing apparatus such as an ultraviolet curable printer may include a printhead to provide ultraviolet curable ink to a substrate to form an image thereon. The ultraviolet curable printer may also include a light source to cure the ultraviolet curable ink on the substrate.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Printing apparatuses include printheads to form images on substrate. A printing apparatus such as an ultraviolet (UV) curable printer may include a printhead to move across a substrate to provide UV curable ink to the substrate to form an image thereon. A gloss level of the image may be dependent on the morphology of the UV curable ink, thickness of the ink layer and a roughness of the ink layer formed on the substrate which impact how light is scattered therefrom. The UV curable printer may also include a light source to cure the UV curable ink of the image on the substrate. Generally, however, the light source may emit a same amount of UV radiation to the entire image to provide an image having a same gloss level. Thus, the printing apparatus may not be able to selectively provide different gloss levels to various areas of an image in an efficient and cost-effective manner.

In examples, a method of printing an image using UV curable ink includes printing the image on a substrate by a printhead using the UV curable ink. The method also includes selectively applying a first amount of UV radiation by a first region of a light source to a first area of the image printed by the printhead after a first amount of time passes from printing the first area to form a first gloss level area having a glossy finish. The method also includes selectively applying a second amount of UV radiation by a second region of the light source to a second area of the image printed by the printhead after a second amount of time passes from printing the second area to form a second gloss level area having a matte finish such that at least one of the second amount of UV radiation is greater than the first amount of UV radiation and the first amount of time is greater than the second amount of time. The amount of time delay between the printing of UV curable ink on the substrate and its initial exposure to UV radiation impacts the uniformity, thickness, and smoothness of the ink layer resulting in different gloss levels thereof. Further, the amount of UV radiation received by UV curable ink on the substrate also impacts the uniformity, thickness, and smoothness of the ink layer resulting in different gloss levels thereof. Thus, the printing apparatus may be able to selectively provide different gloss levels to various areas of an image in an efficient and cost-effective manner.

Figure 1:
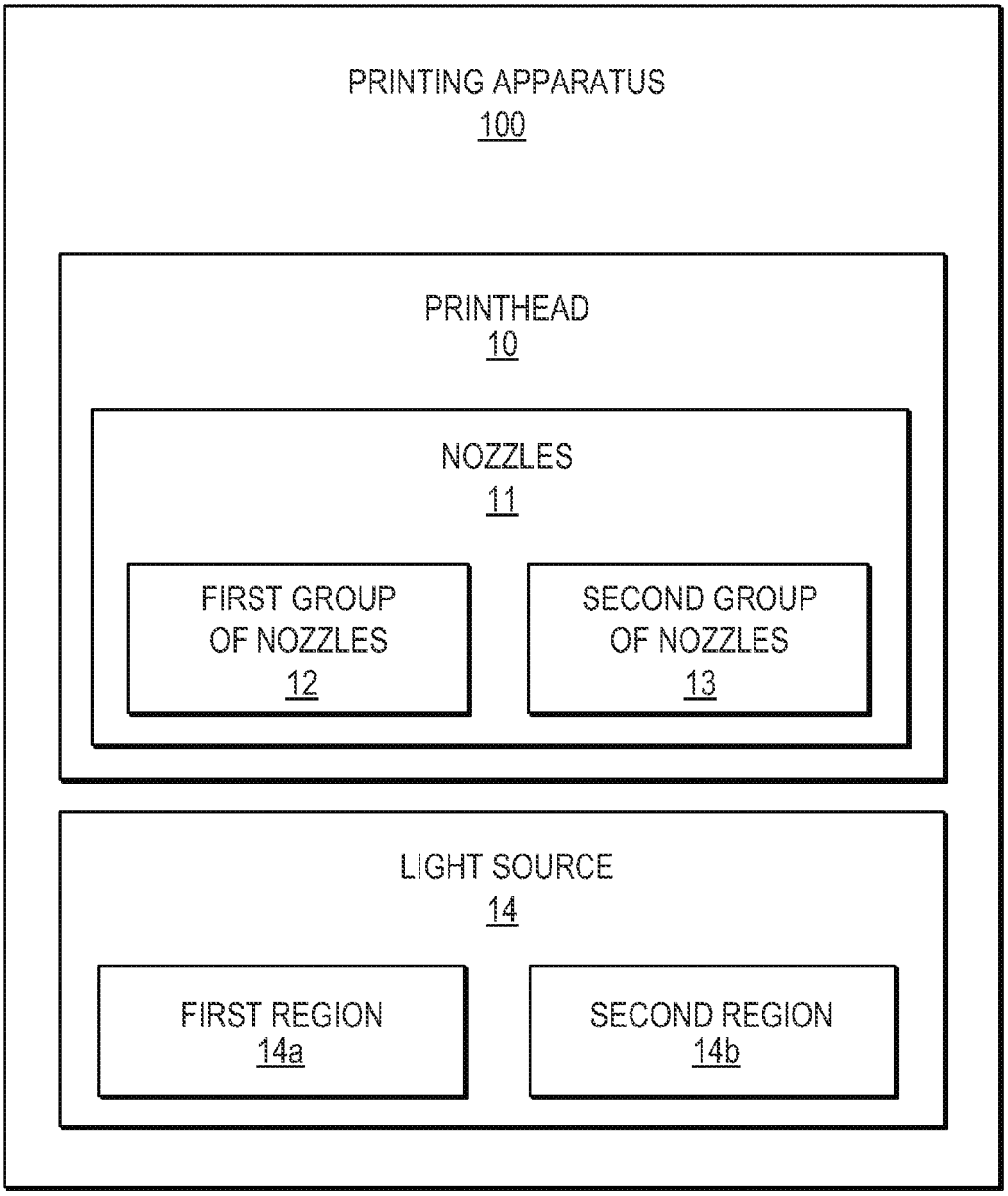
FIG. 1 is a block diagram illustrating a printing apparatus according to an example.

FIG. 1 is a block diagram illustrating a printing apparatus according to an example. Referring to FIG. 1, in some examples, a printing apparatus 100 may include a printhead 10 and a light source 14. The printhead 10 may include nozzles 11 to eject UV curable ink therefrom to print an image on a substrate. The nozzles 11 may include a first group of nozzles 12 to print a first area of the image and a second group of nozzles 13 to print a second area of the image. In some examples, the printhead 10 may include a printhead assembly, a print bar, a plurality of printhead modules, and/or a multicolor inkjet printhead, and the like.

In some examples, the light source 14 may include a light emitting diode array, or a mercury lamp, and the like. For example, the light source 14 may be in a form of a light emitting diode array (FIG. 5) including a first region 14*a* having a first set of addressable light emitting diodes and a second region 14*b* having a second set of addressable light emitting diodes. Alternatively, the light source 14 may be in a form of a mercury lamp that may interact with a masking member. For example, the masking member may selectively cover respective portions of the mercury lamp to block UV radiation emitted therefrom and uncover respective portions of the mercury lamp to unblock UV radiation emitted therefrom directed to the image. In some examples, the light source 14 may include a plurality of light sources.

Referring to FIG. 1, in some examples, the light source 14 may include a first region 14*a* and a second region 14*b*. The first region 14*a* may selectively apply a first amount of UV radiation to the first area after a first amount of time passes from printing the first area to form a first gloss level area having a glossy finish. That is, the UV curable ink of the first area of the image receives the first amount of UV radiation after passage of the first amount of time. In some examples, the first amount of UV radiation may be a lower irradiance level than a full cure irradiance level. The first amount of UV radiation may pin the UV curable ink of the first area of the image on the substrate to limit it from expanding, mixing with surrounding ink drops, and wetting the substrate.

The second region 14*b* may selectively apply a second amount of UV radiation to the second area after a second amount of time passes from printing the second area to form a second gloss level area having a matte finish. That is, the UV curable ink of the second area of the image receives and is cured by the second amount of UV radiation after passage of the second amount of time. In some examples, the second amount of UV radiation may be a higher irradiance level than the first amount of UV radiation such as a full cure irradiance level to receive and fully cure the ink drops of the second area of the image. At least one of the second amount of UV radiation may be greater than the first amount of UV radiation and the first amount of time may be greater than the second amount of time.

Figure 2:
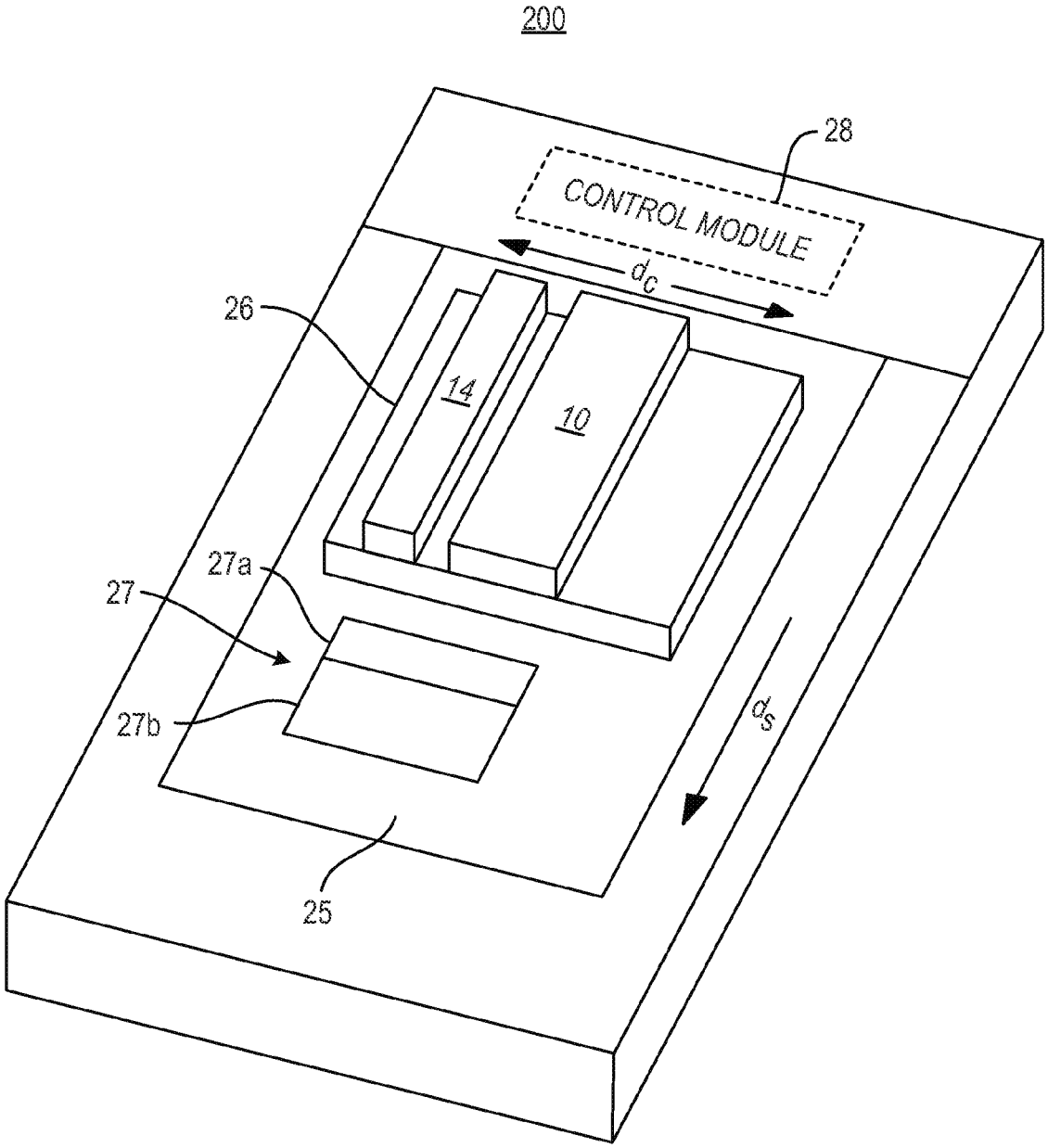
FIG. 2 is a perspective view of a printing apparatus according to an example.

FIG. 2 is a perspective view of a printing apparatus according to an example. Referring to FIG. 2, in some examples, a printing apparatus 200 may include the printhead 10 and the light source 14 as previously described with respect to the printing apparatus 100 of FIG. 1. In some examples, the printing apparatus 200 may also include a carriage 26 and a control module 28. The carriage 26 may be coupled to the printhead 10 and the light source 14. In some examples, the light source 14 may be spaced away from or in contact with the printhead 10. The carriage 26 may move as multiple passes in a carriage transport direction $d_c$ across a substrate 25 to form the image 27 thereon. The substrate 25 may move in a substrate advancement direction $d_s$. In some examples, the substrate advancement direction $d_s$ may be perpendicular to the carriage transport direction $d_c$.

The control module 28 may control the light source 14 such that at least one of the second amount of UV radiation may be greater than the first amount of UV radiation and the first amount of time may be greater than the second amount of time. For example, the control module 28 may enable the second region 14*b* to emit a greater amount of UV radiation onto the second area 27*b* of the image 27 than an amount of UV radiation emitted by the first region 14*a* of the light source 14 onto the first area 27*a* of the image 27. The control module 28 may also enable the first region 14*a* to emit a lesser amount of UV radiation onto the first area 27*a* of the image 27 than an amount of UV radiation emitted by the second region 14*b* onto the second area 27*b* of the image 27.

Alternatively, the control module 28 may control the light source 14 such that the first amount of time (e.g., period of time between printing the first area of the image and emitting a first amount of UV radiation from the first region to the first area) may be greater than the second amount of time (e.g., period of time between printing the second area of the image and emitting a second amount of UV radiation from the second region to the second area). In some examples, the first amount of UV radiation may be in a first range of 0 to 100 milli Joules and the second amount of UV radiation may be in a second range of 300 to 3500 milli Joules.

In some examples, the control module 28 may be implemented in hardware, software including firmware, or combinations thereof. The firmware, for example, may be stored in memory and executed by a suitable instruction-execution system. If implemented in hardware, as in an alternative example, the control module 28 may be implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In some examples, the control module 28 may be implemented in a combination of software and data executed and stored under the control of a computing device.

Figure 3:
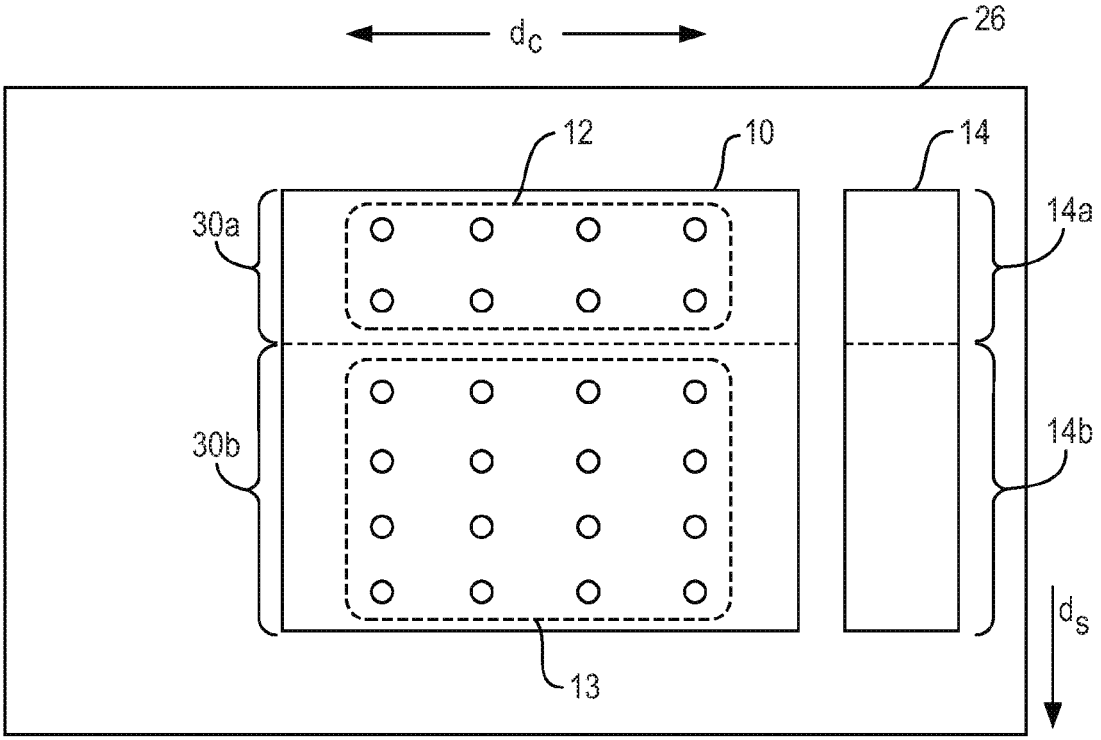
FIG. 3 is a bottom view of a carriage coupled to a printhead and a light source of the printing apparatus of FIG. 2 according to an example.
Figure 4:
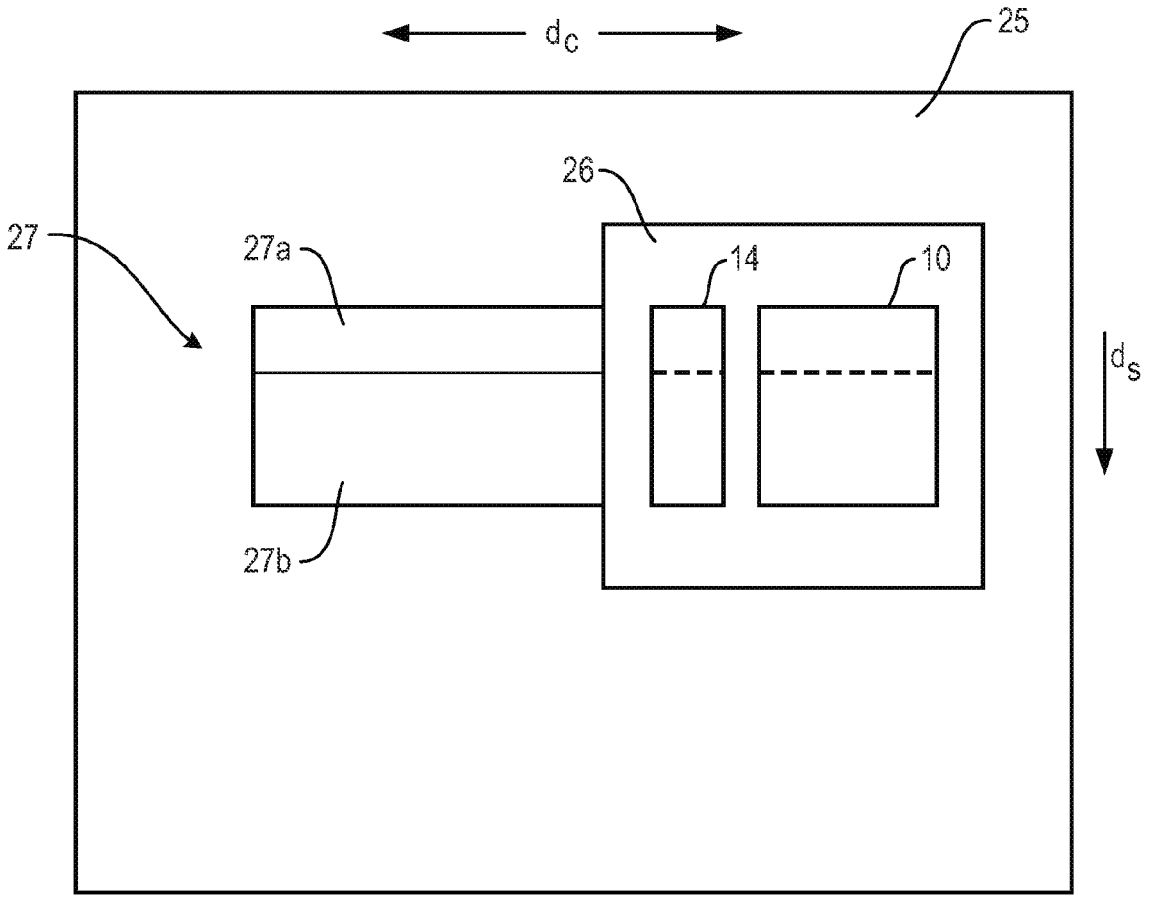
FIG. 4 is a top view illustrating the printhead to print an image on a substrate and a light source coupled to a carriage of the printing apparatus of FIG. 2 according to an example.

FIG. 3 is a bottom view of a carriage coupled to a printhead and a light source of the printing apparatus of FIG. 2 according to an example. FIG. 4 is a top view illustrating the printhead to print an image on a substrate and a light source coupled to the carriage of the printing apparatus of FIG. 2 according to an example. Referring to FIGS. 3-4, in some examples, the printhead 10 may include a first section 30*a* and a second section 30*b*. The first group of nozzles 12 may be disposed on the first section 30*a* of the printhead 10. The second group of nozzles 13 may be disposed on the second section 30*b* of the printhead 10. The first region 14*a* of the light source 14 may be proximate to the first section 30*a* of the printhead 10 and the second region 14*b* of the light source 14 may be proximate to the second section 30*b* of the printhead 10. For example, the first region 14*a* of the light source 14 may be adjacent to the first section 30*a* of the printhead 10 and the second region 14*b* of the light source 14 may be adjacent to the second section 30*b* of the printhead 10.

In some examples, each one of the first region 14*a* and the second region 14*b* of the light source 14 may be configured to apply the respective amounts of UV radiation during a same pass of the carriage 26 across the substrate 25. For example, the first amount of UV radiation by the first region 14*a* and the second amount of UV radiation by the second region 14*b* may be simultaneously applied to respective areas 27*a* and 27*b* of the image 27. In some examples, an intersection between the first section 30*a* and the second section 30*b* of the printhead 10 may be aligned with an intersection between the first region 14*a* and the second region 14*b* of the light source 14. Further, in some examples, the first section 30*a* and the second section 30*b* may have different sizes that correspond to a multiple of an image advance.

For example, the image 27 may be printed on the substrate 25 by a printhead 10 during a succession of carriage passes. That is, UV curable ink may be selectively applied on the substrate 25 after a respective substrate and image advance between carriage passes in which a new portion of the substrate 25 becomes addressable by the printhead 10 and the light source 14. The substrate movement in the substrate advancement direction $d_s$ may be perpendicular to the carriage transport direction $d_c$. Consequently, an amount of substrate and image advance may be such that the first section 30*a* may apply a first amount of UV radiation on a respective first area 27*a* of the image 27, and the second section 30*b* may apply a second amount of UV radiation on a respective second area 27*b* of the image 27.

Alternatively, each one of the first region 14*a* and the second region 14*b* of the light source 14 may apply the respective amounts of UV radiation during different passes of the carriage 26 across the substrate 25. For example, during a respective pass of the carriage 26, the first group of nozzles 12 may be configured to print the first area 27*a* of the image 27. Additionally, the first region 14*a* of the light source 14 may be configured to selectively apply the first amount of UV radiation to the first area 27*a* of the image 27 after the first amount of time passes from printing the first area 27*a* to form the first gloss level area having the glossy finish. Subsequently, during another respective pass of the carriage 26, the second group of nozzles 13 may be configured to print the second area 27*b* of the image 27. Additionally, the second region 14*b* of the light source 14 may be configured to selectively apply the second amount of UV radiation to the second area 27*b* of the image 27 after the second amount of time passes from printing the second area 27*b* to form the second gloss level area having the matte finish.

Figure 5:
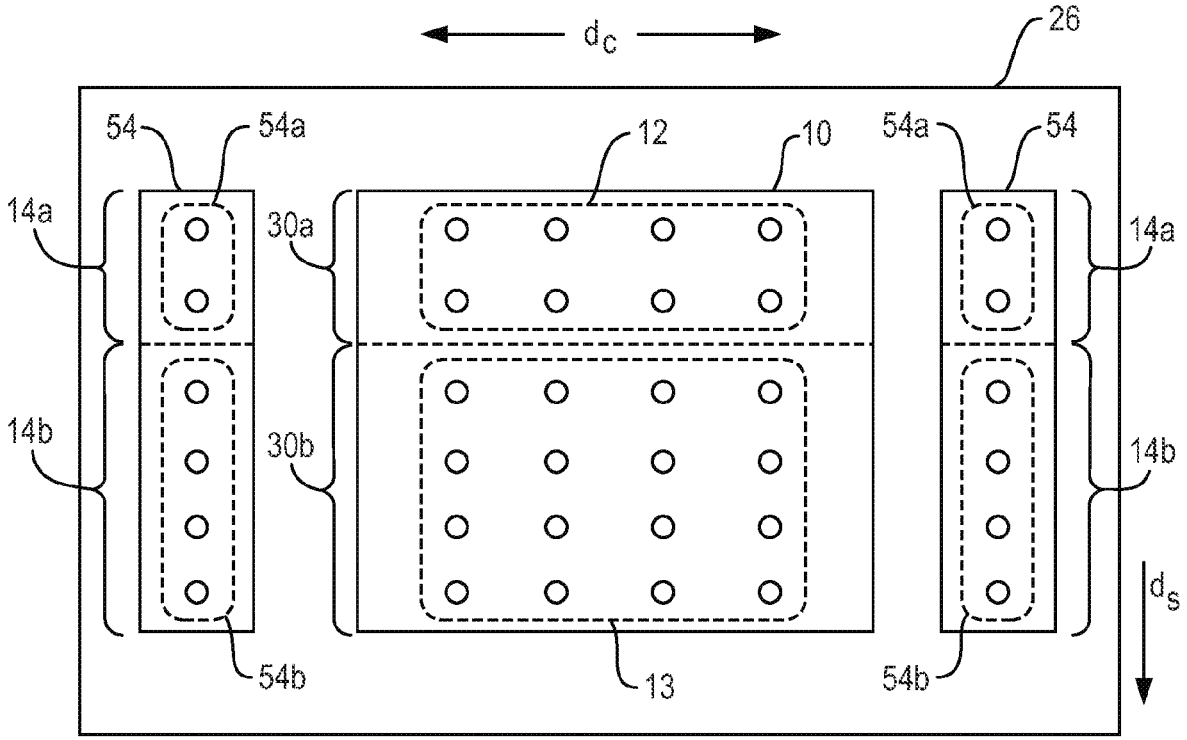
FIG. 5 is a bottom view of a carriage coupled to a printhead and a light emitting diode array of a printing apparatus according to an example.

FIG. 5 is a bottom view of a carriage coupled to a printhead and a light emitting diode array of a printing apparatus according to an example. Referring to FIG. 5, in some examples, the light source 14 (FIG. 3) may include a light emitting diode (LED) array 54. The LED array 54 may include the first region 14*a* and the second region 14*b*. The first region 14*a* may have a first set of addressable light emitting diodes 54*a*. The second region 14*b* may have a second set of addressable light emitting diodes 54*b*. For example, an amount of UV radiation emitted from each one of the addressable LEDs 54*a* and 54*b* may be independently selected individually and/or as a group. In some examples, portions of the LED array 54 may be disposed proximate to opposite sides of the printhead 10 to facilitate the pinning and/or curing of the image 27 formed, for example, by bi-directional printing. In some examples, the printhead 10 may be in a form of a multicolor inkjet printhead having a plurality of sets of nozzles arranged in columns in which each set may correspond to a respective color.

Figure 6:
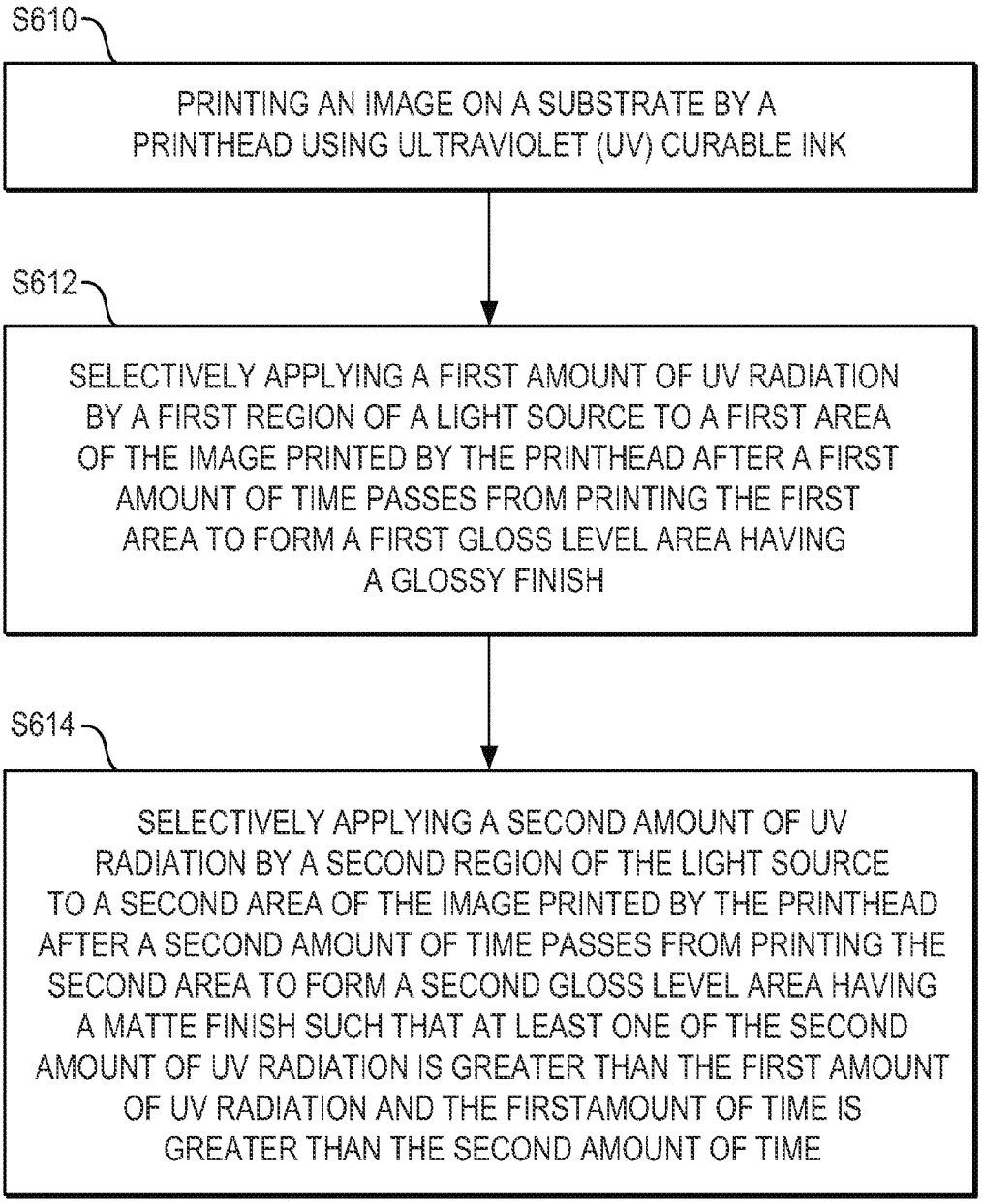
FIG. 6 is a flowchart illustrating a method of printing an image using ultraviolet curable ink according to an example.

FIG. 6 is a flowchart illustrating a method of printing an image using UV curable ink according to an example. In block S610, the image on a substrate is printed by a printhead using the UV curable ink. In some examples, printing the image on a substrate by a printhead using the UV curable ink may also include moving a carriage coupled to the printhead and the light source as multiple passes across the substrate to form the image thereon. In block S612, a first amount of UV radiation is selectively applied by a first region of a light source to a first area of the image printed by the printhead after a first amount of time passes from printing the first area to form a first gloss level area having a glossy finish. For example, the first area of the image may be printed by a first group of nozzles of the printhead and the first amount of UV radiation may be selectively applied to the first area of the image by the first region by a LED array. The first amount of UV radiation may be applied after the first amount of time passes from printing the first area to form the first gloss level area having the glossy finish during a respective pass of the carriage across the substrate.

In block S614, a second amount of UV radiation is selectively applied by a second region of the light source to a second area of the image printed by the printhead after a second amount of time passes from printing the second area to form a second gloss level area having a matte finish. The second amount of UV radiation is selectively applied such that at least one of the second amount of UV radiation is greater than the first amount of UV radiation and the first amount of time is greater than the second amount of time. For example, the second area of the image may be printed by a second group of nozzles of the printhead and the second amount of UV radiation may be selectively applied to the second area of the image by the second region by a LED array. The second amount of UV radiation may be selectively applied after the second amount of time passes from printing the second area to form the second gloss level area having the matte finish during another respective pass of the carriage across the substrate. In some examples, the first amount of time may be greater than the second amount of time. In some examples, the second amount of UV radiation may be greater than the first amount of UV radiation. In some examples, each one of the first and second amount of UV radiation may be based on at least one of an amount of time UV radiation is applied, an intensity of applied UV radiation, and an amount of time between printing of UV curable ink on a portion of the substrate and an application of UV radiation thereto.

It is to be understood that the flowchart of FIG. 6 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 6 illustrates a specific order of execution, the order of execution may differ from that which is depicted. For example, the order of execution of two or more blocks may be rearranged relative to the order illustrated. Also, two or more blocks illustrated in succession in FIG. 6 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

The invention claimed is:

1. A method of printing an image using ultraviolet (UV) curable ink, the method comprising:

determining a first portion of the image and a second portion of the image;

at a first point in time, printing the first portion of the image on a substrate by a first portion of a printhead using the UV curable ink;

at a second point in time after the first point in time, selectively applying a first amount of UV radiation by a first region of a light source to the first portion of the image printed by the printhead to create a first finish on a first area of the substrate;

at a third point in time after the second point in time, printing the second portion of the image on the substrate by a second portion of the printhead using the UV curable ink; and at a fourth time after the third point in time, selectively applying a second amount of UV radiation by a second region of the light source to the second portion of the image printed by the printhead to create a second finish on a second area of the substrate, wherein a first length of time from the first point in time to the second point in time is different than a second length of time from the third point in time to the fourth point in time.

2. The method according to claim 1, wherein the second amount of UV radiation is different than the first amount of UV radiation.

3. The method according to claim 1, wherein each one of the first and second amount of UV radiation is based on at least one of an amount of time UV radiation is applied, an intensity of applied UV radiation, and an amount of time between printing of UV curable ink on a portion of the substrate and an application of UV radiation thereto.

4. The method according to claim 1, wherein the first amount of time is greater than the second amount of time.

5. The method according to claim 1, wherein the second amount of UV radiation is greater than the first amount of UV radiation.

6. The method according to claim 1, wherein the first finish is a glossy finish and the second finish is a matte finish.

7. A printing apparatus, comprising:

a printhead having nozzles to eject ultraviolet (UV) curable ink therefrom to print an image on a substrate, the nozzles including a first group of nozzles and a second group of nozzles;

a light source having first and second regions to selectively apply UV radiation; and a control module to:

determine a first portion of the image and a second portion of the image, cause the printhead to print at a first point in time the first portion of the image with the first group of nozzles and to print at a third point in time after the first point in time the second portion of the image with the second group of nozzles, and cause the first region of the light source to apply at a second point in time after the first point in time and before the third point in time a first amount of UV radiation to the first portion to form a first finish on a first substrate area and cause the second region to apply at a fourth time after the third point in time a second amount of UV to form a second finish on a second substrate area, wherein a first length of time between the first point in time and the second point in time is different than a second length of time between the third point in time and the fourth point in time.

8. The printing apparatus according to claim 7, wherein the first group of nozzles is disposed on a first section of the printhead and the second group of nozzles is disposed on a second section of the printhead such that the first region of the light source is proximate to the first section of the printhead and the second region of the light source is proximate to the second section of the printhead.

9. The printing apparatus according to claim 7, further comprising:

a carriage coupled to the printhead and the light source, the carriage to move as multiple passes across the substrate to form the image thereon.

10. The printing apparatus according to claim 9, wherein each one of the first region and the second region is configured to apply the respective amounts of UV radiation during a same pass of the carriage across the substrate.

11. The printing apparatus according to claim 9, wherein during a respective pass of the carriage across the substrate, the first group of nozzles is configured to print the first portion of the image and the first region is configured to selectively apply the first amount of UV radiation to the first portion of the image after the first amount of time passes from printing the first portion to form the first finish; and wherein during another respective pass of the carriage across the substrate, the second group of nozzles is configured to print the second portion of the image and the second region is configured to selectively apply the second amount of UV radiation to the second portion of the image after the second amount of time passes from printing the second portion to form the second matte finish.

12. The printing apparatus according to claim 7, wherein the control module is to instruct the light source to make the second amount of UV radiation greater than the first amount of UV radiation or the first amount of time greater than the second amount of time.

13. The printing apparatus according to claim 7, wherein the light source includes a light emitting diode (LED) array including the first region having a first set of addressable light emitting diodes and the second region having a second set of addressable light emitting diodes.

14. The printing apparatus according to claim 7, wherein the control module is to instruct the first region of the light source to apply the first amount of UV radiation during a same pass in which the control module instructs the second region of the light source to apply the second amount of UV radiation.

15. The printing apparatus according to claim 7, wherein the first amount of UV radiation is a lower irradiance level than a full cure irradiance level, and wherein the first amount of UV radiation is sufficient to pin the UV curable ink to prevent further wetting of the substrate.

16. A non-transitory computer-readable data storage medium storing computer-executable code that a processor executes to:

determine a first portion of the image and a second portion of the image;

at a first point in time, cause a first portion of a printhead to print the first portion of the image on a substrate using ultraviolet (UV) curable ink;

at a second point in time after the first point in time, cause a first region of a light source to selectively apply a first amount of UV radiation to the first portion of the image printed by the printhead to create a first finish;

at a third point in time after the second point in time, cause a second portion of the printhead to print the second portion of the image on the substrate using the UV curable ink; and at a fourth time after the third point in time, cause a second region of the light source to selectively apply a second amount of UV radiation to the second portion of the image printed by the printhead to create a second finish, wherein a first length of time between the first point in time and the second point in time is different than a second length of time between the third point in time and the fourth time.

17. The non-transitory computer-readable data storage medium according to claim 16, wherein the second amount of UV radiation is different than the first amount of UV radiation.

18. The non-transitory computer-readable data storage medium according to claim 16, wherein each one of the first and second amount of UV radiation is based on at least one of an amount of time UV radiation is applied, an intensity of applied UV radiation, and an amount of time between printing of UV curable ink on a portion of the substrate and an application of UV radiation thereto.

19. The non-transitory computer-readable data storage medium according to claim 16, wherein the first amount of time is greater than the second amount of time, and wherein the second amount of UV radiation is greater than the first amount of UV radiation.

20. The non-transitory computer-readable data storage medium according to claim 16, wherein the first finish is a glossy finish and the second finish is a matte finish.

* * * * *